US007832722B1

(12) United States Patent
Huang

(10) Patent No.: US 7,832,722 B1
(45) Date of Patent: Nov. 16, 2010

(54) PAPER FEEDING DEVICE

(75) Inventor: Ying-Chieh Huang, Taipei County (TW)

(73) Assignee: Kinpo Electronics, Inc., Taipei (TW)

( * ) Notice: Subject to any disclaimer, the term of this patent is extended or adjusted under 35 U.S.C. 154(b) by 78 days.

(21) Appl. No.: 12/430,329

(22) Filed: Apr. 27, 2009

(51) Int. Cl.
*B65H 3/52* (2006.01)
*B65H 3/34* (2006.01)

(52) U.S. Cl. ..... 271/121; 271/124; 271/149; 271/167

(58) Field of Classification Search ..... 271/121, 271/124, 149, 167, 104, 137
See application file for complete search history.

(56) References Cited

U.S. PATENT DOCUMENTS 6,502,816 B2 * 1/2003 Inoue et al. ..... 271/121
2002/0175462 A1 * 11/2002 Sonoda et al. ..... 271/121
2006/0038339 A1 * 2/2006 Shimamura ..... 271/121
2007/0222139 A1 * 9/2007 Hotani ..... 271/121
2008/0211169 A1 * 9/2008 Klein ..... 271/167
2009/0026693 A1 * 1/2009 Lim ..... 271/121

* cited by examiner

*Primary Examiner*—David H Bollinger
(74) *Attorney, Agent, or Firm*—J.C. Patents

(57) ABSTRACT

A paper feeding device includes a supporting base and a paper arranging module. The supporting base has a supporting surface, an inclined supporting plane, and a slot located at the supporting surface. The paper arranging module includes a guiding structure fixed under the supporting surface, a paper-pushing structure slidably disposed on the guiding structure, an elastic element interconnected between the paper-pushing structure and a fixed end, and a gear disposed on the guiding structure. The gear has an engaging part for engaging with and driving the paper-pushing structure to move toward the inclined supporting plane along the slot for arranging the paper sheets supported on the supporting base, thus facilitating subsequent paper dividing. When a non-engaging part of the gear corresponds to the paper-pushing structure, the paper-pushing structure is restored to an original position by an elastic force of the elastic element.

9 Claims, 6 Drawing Sheets

PAPER FEEDING DEVICE

BACKGROUND OF THE INVENTION

1. Field of the Invention

The present invention relates generally to a paper feeding device, and more particularly, to a paper feeding device suitable for a multi-function peripheral.

2. Description of Related Art

In the informationized society, offices are equipped with automatic equipments such as a scanner, a photocopier or a printer. Users can perform various document processing operations through the use of these automatic equipments. If these automatic equipments are individually disposed in the office, they may occupy a considerable amount of space. Accordingly, a multi-function peripheral (MFP) which integrates the function of photocopying, printing and scanning has been developed to solve the foregoing problem.

The user usually places a stack of paper sheets in the MFP for photocopying, printing or scanning. In order to enable the MFP to pick up one single sheet of paper each time, the paper feeding module typically includes a paper separating member. A most common way is to use buckling of the paper sheet. For example, the buckling of the paper sheet can be achieved by using a friction force of a paper separation member such as a friction pad or a saw-tooth structure. However, this way of paper separation has an operation limitation, i.e., the paper sheet is required to be disposed at a particular range of angle with respect to the paper separating member for effective paper separation. In other words, if the paper sheets are not arranged to be disposed at the particular angle with respect to the paper separating member prior to paper separation, the probability of successful separation would be reduced.

SUMMARY OF THE INVENTION

Accordingly, the present invention is directed to a paper feeding device which can arrange the paper sheets.

The present invention provides a paper feeding device suitable for a multi-function peripheral. The paper feeding device includes a supporting base, a feeding element, a paper dividing element, and a paper arranging module. The supporting base is used to support paper sheets and has a supporting surface, an inclined supporting plane extending upwardly from one end of the supporting surface, and a slot located at the supporting surface. The feeding element is disposed above the inclined supporting plane and used to drive the paper sheets to move from the inclined supporting plane to the supporting surface. The paper dividing element disposed on the supporting surface to divide the paper sheets. The paper arranging module includes a guiding structure, a paper-pushing structure, a first elastic member, and a gear. The guiding structure is fixed to the supporting base and disposed under the supporting surface. The paper-pushing structure is slidably disposed on the guiding structure. The first elastic element is interconnected between the paper-pushing structure and a fixed end. The gear is disposed on the guiding structure adjacent the paper-pushing structure and configured to rotate in a single direction. The gear includes a first engaging part and a non-engaging part. When the gear rotates such that the first engaging part engages with the paper-pushing structure and drives the paper-pushing structure to slide relative to the guiding structure against the elastic force of the first elastic element, a portion of the paper-pushing structure protrudes beyond the supporting surface via the slot and moves toward the inclined supporting plane along the slot to thereby push the paper sheets to the inclined supporting plane; when the gear rotates such that the non-engaging part corresponds to the paper-pushing structure, the paper-pushing structure moves relative to the guiding structure under the elastic force of the first elastic element, causing the portion of the paper-pushing structure protruding beyond the supporting surface to move away from the inclined supporting plane to below the supporting surface.

According one embodiment of the present invention, the paper dividing element is a friction pad.

According one embodiment of the present invention, the feeding element is a roller.

According one embodiment of the present invention, the first elastic element is a spring.

According one embodiment of the present invention, the paper feeding device further includes a one-way wheel coupled to the gear to limit the gear to rotate in the single direction.

According one embodiment of the present invention, the guiding structure has a slide slot in which the paper-pushing structure is slidably disposed.

According one embodiment of the present invention, the gear further includes a second engaging part. When the gear rotates such that the second engaging part engages with the paper-pushing structure and drives the paper-pushing structure to move against the elastic force of the first elastic element, a portion of the paper-pushing structure protrudes beyond the supporting surface via the slot and moves toward the inclined supporting plane along the slot and is positioned at a particular location on the supporting surface.

According one embodiment of the present invention, the paper-pushing structure includes a main body, a paper-pushing element, and a second elastic element. The main body is slidably disposed on the guiding structure and includes a rack for engaging with the first engaging part of the gear. The paper-pushing element corresponds to the slot for pushing the paper sheets to move. The second elastic element is interconnected between the main body and the paper-pushing element. When the paper sheets are pushed to the inclined supporting plane, a minimal distance between the paper-pushing element and the inclined supporting plane is adjusted to be substantial equal to an overall thickness of a stack of the paper sheets by using the elastic deformation of the second elastic element.

According one embodiment of the present invention, the second elastic element is a spring.

In view of the foregoing, in the present invention, under the driving of the engaging part of the gear, the paper-pushing structure can push the paper sheets to the inclined supporting plane to arrange the paper sheets. When the non-engaging part of the gear corresponds to the paper-pushing structure, the elastic element interconnected between the paper-pushing structure and the fixed end can restore the paper-pushing structure to its original position, such that the paper sheets can be delivered toward the supporting surface by the feeding element to be divided. The arranged paper is divided by the paper dividing element and as such, the probability of successfully feeding the paper sheet by sheet is increased.

In order to make the aforementioned and other features and advantages of the present invention more comprehensible, embodiments accompanied with figures are described in detail below.

DESCRIPTION OF THE EMBODIMENTS

Figure 1:
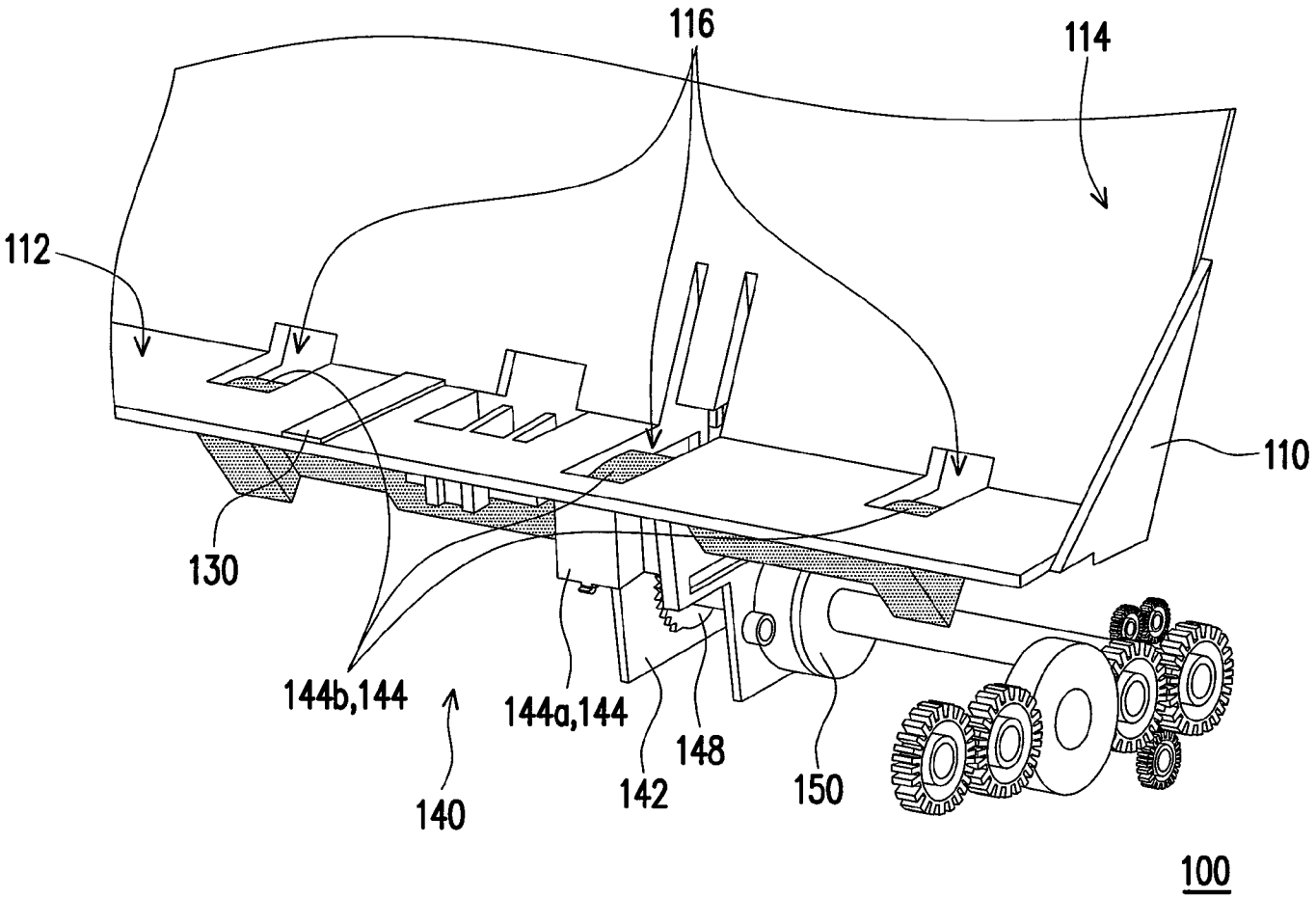
FIG. 1 is a partial perspective view of a paper feeding device according to an embodiment of the present invention.
Figure 2:
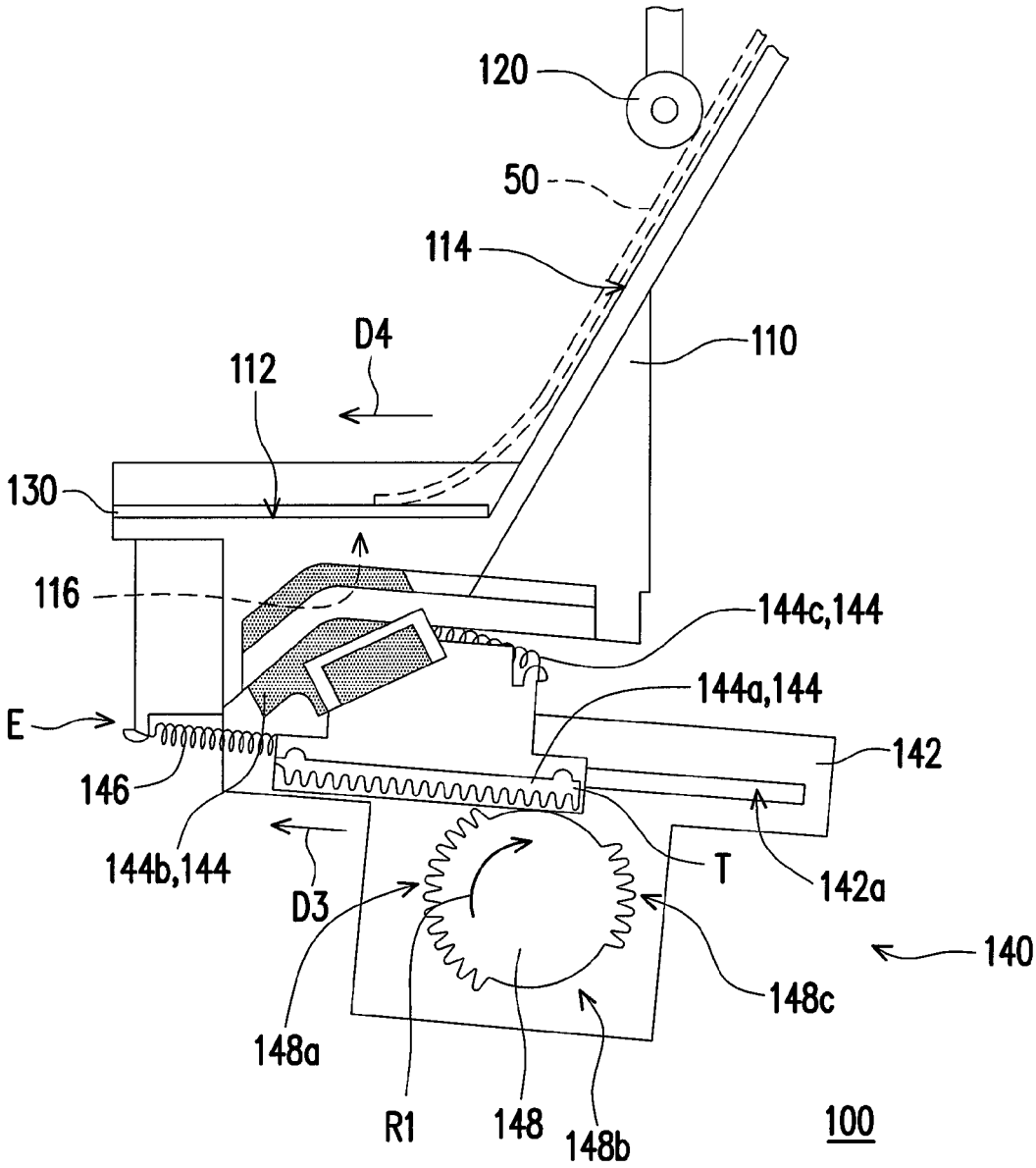
FIG. 2 is a partial cross sectional view of the paper feeding device of FIG. 1.

FIG. 1 is a partial perspective view of a paper feeding device according to one embodiment of the present invention. FIG. 2 is a partial cross sectional view of the paper feeding device of FIG. 1. Referring to FIGS. 1 and 2, the paper feeding device 100 of the present embodiment may be suitable for a multi-function peripheral (MFP) (not shown). The paper feeding device 100 includes a supporting base 110, a feeding element 120 (illustrated in FIG. 2), a paper dividing element 130, and a paper arranging module 140. The supporting base 110 used to support multiple sheets of paper 50 (not shown in FIG. 2) includes a supporting surface 112, an inclined supporting plane 114 extending upwardly from one end of the supporting surface 112, and at least one slot 116 (three slots are illustrated) located at the supporting surface 112. In the present embodiment, the feeding element 120 is, for example, a roller.

The feeding element 120 is disposed above the inclined supporting plane 114 and drives the paper sheet 50 to move from the inclined supporting plane 114 to the supporting surface 112. The paper dividing element 130 is disposed under the supporting surface 112 to divide the paper sheets 50. The paper arranging module 140 includes a guiding structure 142, a paper-pushing structure 144, a first elastic element 146, and a gear 148. The guiding structure 142 is fixed to the supporting base 110 and disposed below the supporting surface 112. The paper-pushing structure 144 is slidably disposed on the guiding structure 142. The first elastic element 146 is interconnected between the paper-pushing structure 144 and a fixed end E (for example, the fixed end E is a structure fixed to the supporting base 110 in the present embodiment). The gear 148 is disposed on the guiding structure 142 adjacent the paper-pushing structure 144 and is configured to rotate in a single direction. The gear 148 has a first engaging part 148*a* and a non-engaging part 148*b*. In other words, the gear 148 of the present embodiment is, for example, a partially toothed gear, with the first engaging part 148*a* and the non-engaging part 148*b* representing the toothed portion and non-toothed portion on the periphery of the partially toothed gear, respectively. Referring to FIG. 1, a one-way wheel 150 coupled to the gear 148 may be used to limit the gear 148 to rotate in the single direction. The purpose of limiting the gear 148 to rotate in the single direction is to prevent the gear 148 from being driven to rotate in a direction reversed to a direction R1 by the elastic force of the first elastic element 146 which would result in the failure in positioning the gear 148.

Figure 3A:
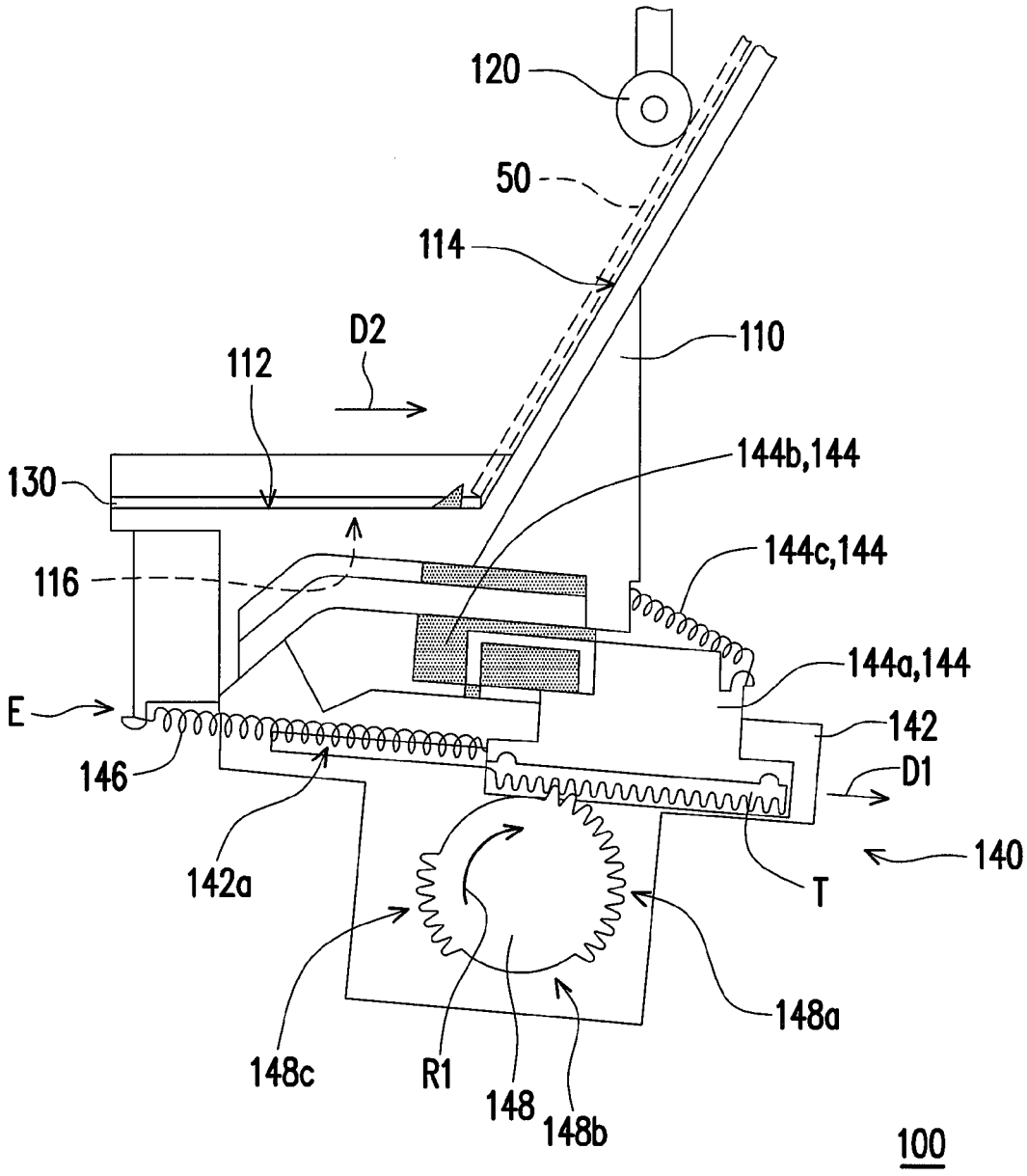
FIGS. 3A and 3B are operational views of the paper arranging module of FIG. 2.
Figure 3B:
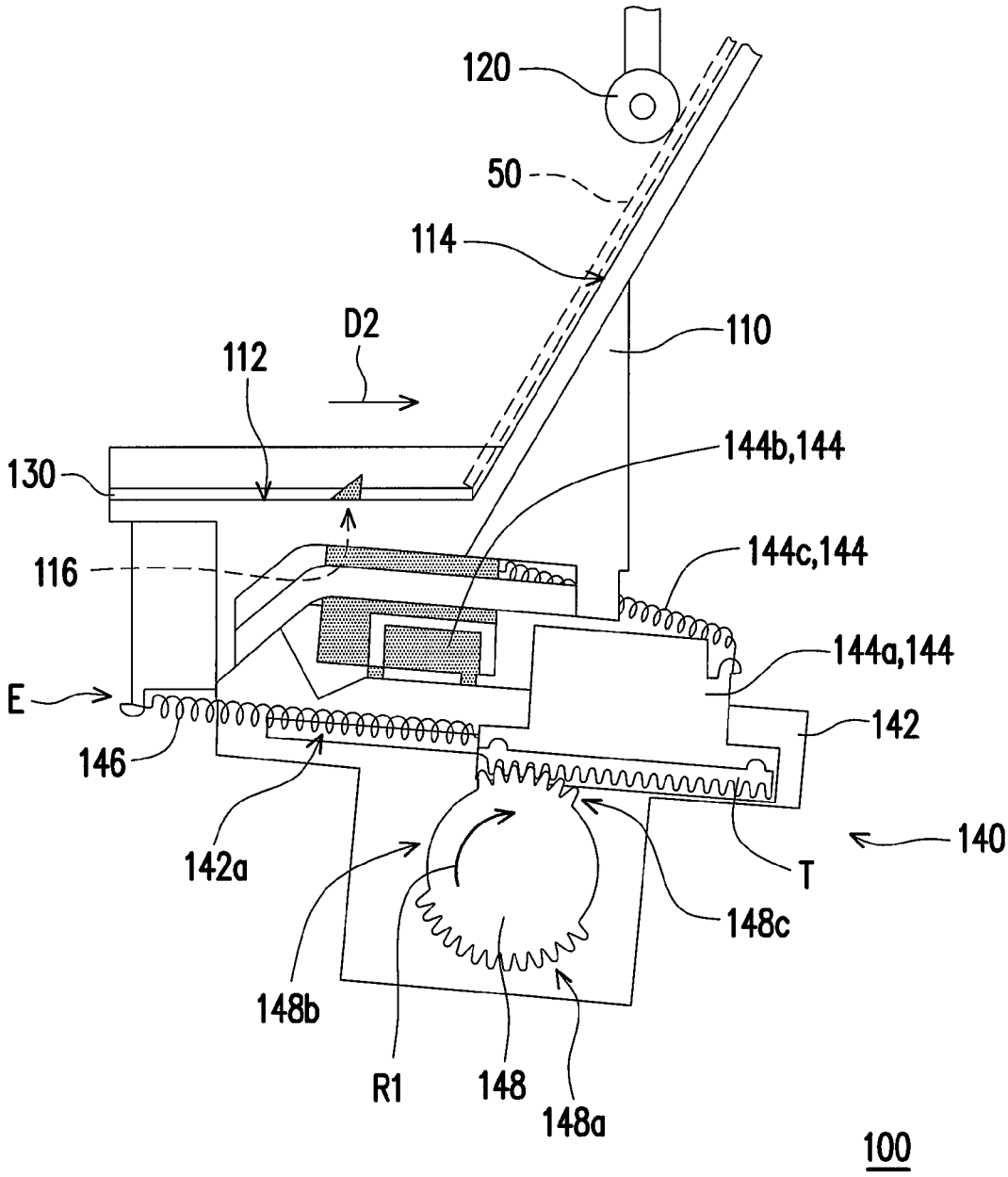
Figure 4A:
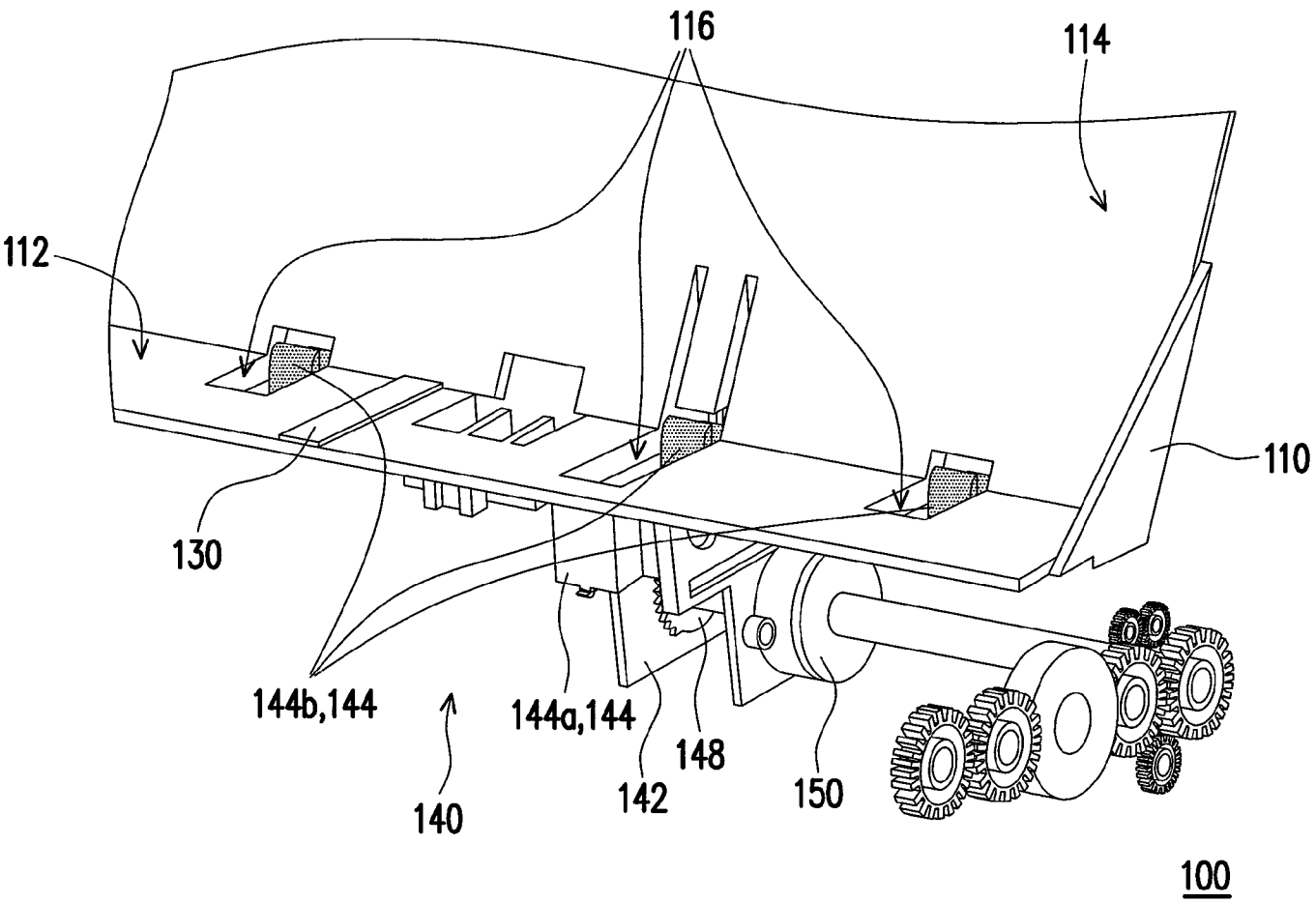
FIGS. 4A and 4B are perspective views of the paper feeding device of FIGS. 3A and 3B, respectively.
Figure 4B:
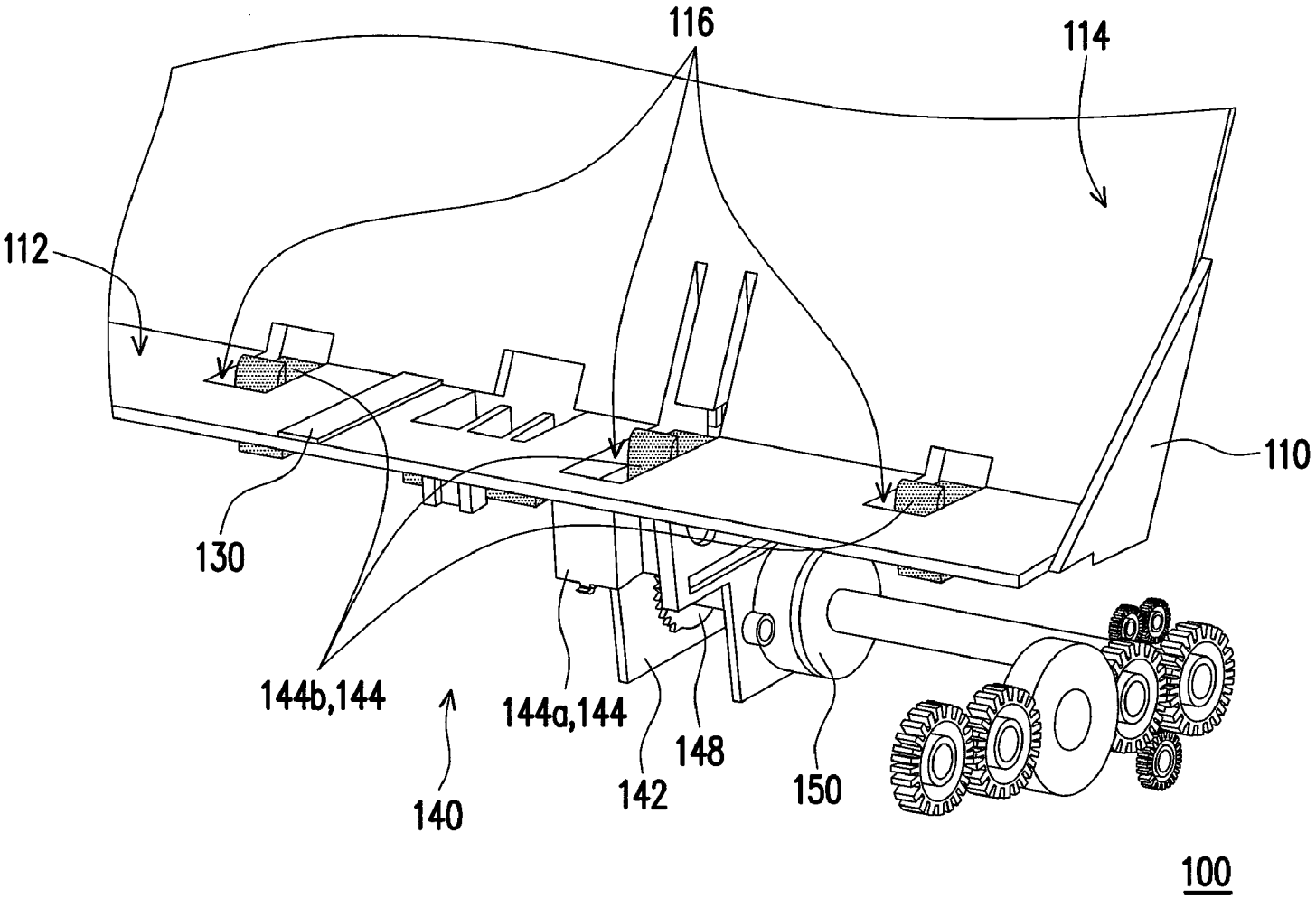

FIGS. 3A and 3B are operational views of the paper arranging module of FIG. 2. FIGS. 4A and 4B are perspective views of the paper feeding device of FIGS. 3A and 3B, respectively. Referring to FIGS. 3A and 4A, when the gear 148 rotates in the direction R1 such that the first engaging part 148*a* engages with the paper-pushing structure 144 and drives the paper-pushing structure 140 to slide in a direction D1 relative to the guiding structure 142 against the elastic force of the first elastic element 146, a portion of the paper-pushing structure 144 protrudes beyond the supporting surface 112 via the slot 116 and moves toward the inclined supporting plane 114 in a direction D2 to thereby push the paper sheets 50 to the inclined supporting plane 114. Referring to FIGS. 1 and 2, when the gear 148 rotates in the direction R1 such that the non-engaging part 148*b* corresponds to the paper-pushing structure 144, the paper-pushing structure 144 moves in a direction D3 relative to the guiding structure 142 under the elastic force of the first elastic element 146, causing the portion of the paper-pushing structure 144 protruding beyond the supporting surface 144 to move away from the inclined supporting plane 114 to below the supporting surface 112 in a direction D4. In the present embodiment, the first elastic element 146 is, for example, a spring.

In other words, with the driving of the engaging part 148*a* of the gear 148, the paper-pushing structure 144 can push the paper sheets 50 to the inclined supporting plane 114 for arranging the paper sheets 50. When the non-engaging part 148*b* of the gear 148 corresponds to the paper-pushing structure 144, the elastic element 146 interconnected between the paper-pushing structure 144 and the fixed end E can restore the paper-pushing structure 144 to its original position such that the paper sheets 50 can be delivered to the supporting surface 112 by the feeding element 120 to allow paper dividing by the paper dividing element 130. In the present embodiment, the paper dividing element 130 is, for example, a friction pad, which divides one paper sheet from the multiple paper sheets 50 by using a friction force to cause buckling of that one paper sheet.

Referring to FIG. 2, specifically, the guiding structure 142 has a slide slot 142*a* in which the paper-pushing structure 144 is slidably disposed. The paper-pushing structure 144 includes a main body 144*a*, at least one paper-pushing element 144*b* (three paper-pushing elements are illustrated), and a second elastic element 144*c*. The main body 144*a* is slidably disposed in the slide slot 142*a* and includes a rack T for engaging with the first engaging part 148*a* of the gear 148. Each paper-pushing element 144*b* for pushing the paper sheets 50 is positioned in correspondence with a respective one of the slots 116 (as shown in FIG. 1). The second elastic element 144*c* is interconnected between the main body 144*a* and the paper-pushing elements 144*b*.

Referring to FIG. 3A, when the paper sheets 50 are pushed to the inclined supporting plane 114, a minimal distance between the paper-pushing elements 144*b* and the inclined supporting plane 114 is adjusted to be substantial equal to an overall thickness of the stack of the paper sheets 50 by using the elastic deformation of the second elastic element 144*c*. In other words, the paper sheets 50 can keep the paper-pushing elements 144*b* apart from the inclined supporting plane 114 by using the elastic deformation of the second elastic element 144*c*, such that the stack of paper sheets 50 having different quantities (i.e., having different thickness) can all be properly sandwiched between the paper-pushing elements 144*b* and the inclined supporting plane 114. In the present embodiment, the second elastic element 144*c* is, for example, a spring.

Referring to FIGS. 3B and 4B, in the present embodiment, the gear 148 further includes a second engaging part 148*c*. When the gear 148 rotates in the direction R1 such that the second engaging part 148 engages with the paper-pushing structure 144 and drives the paper-pushing structure 144 to move against the elastic force of the first elastic element 146, the paper-pushing elements 144*b* protrude beyond the supporting surface 112 via the slots 116 and move toward the inclined supporting plane 114 in the direction D2 and are positioned at a particular location on the supporting surface 112. The paper-pushing elements 144*b* positioned at the particular location on the supporting surface 112 can block the paper sheets 50 so as to prevent the paper sheets 50 placed on the supporting base 110 from directly moving over the slots 116 which would cause the paper-pushing elements 144*b* not to be able to reliably arrange the paper sheets 50.

In summary, in the present invention, under the driving of the engaging part of the gear, the paper-pushing structure can push the paper sheets to the inclined supporting plane for arranging the paper sheets. When the non-engaging part of the gear corresponds to the paper-pushing structure, the elastic element interconnected between the paper-pushing structure and the fixed end can restore the paper-pushing structure to its original position, such that the paper sheets can be delivered toward the supporting surface by the feeding element to be divided. The arranged paper is divided by the paper dividing element and as such, the probability of successfully feeding the paper sheet by sheet is increased. In addition, the paper-pushing structure is positioned at a particular location on the supporting surface to properly limit a moving range of the paper so that the paper-pushing structure can actually arrange the paper.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A paper feeding device for an image formation apparatus, the paper feeding device comprising:

a supporting base adapted to support paper sheets and having a supporting surface, an inclined supporting plane extending upwardly from one end of the supporting surface, and a slot located at the supporting surface;

a feeding element disposed above the inclined supporting plane and adapted to drive the paper sheets to move from the inclined supporting plane to the supporting surface;

a paper dividing element disposed on the supporting surface to divide the paper sheets;

a paper arranging module comprising:

a guiding structure fixed to the supporting base and disposed under the supporting surface;

a paper-pushing structure slidably disposed on the guiding structure;

a first elastic element interconnected between the paper-pushing structure and a fixed end; and a gear disposed on the guiding structure adjacent the paper-pushing structure and configured to rotate in a single direction, wherein the gear comprises a first engaging part and a non-engaging part, when the gear rotates such that the first engaging part engages with the paper-pushing structure and drives the paper-pushing structure to slide relative to the guiding structure against the elastic force of the first elastic element, a portion of the paper-pushing structure protrudes beyond the supporting surface via the slot and moves toward the inclined supporting plane along the slot to thereby push the paper sheets to the inclined supporting plane; when the gear rotates such that the non-engaging part corresponds to the paper-pushing structure, the paper-pushing structure moves relative to the guiding structure under the elastic force of the first elastic element, causing the portion of the paper-pushing structure protruding beyond the supporting surface to move away from the inclined supporting plane to below the supporting surface.

2. The paper feeding device according to claim 1, wherein the paper dividing element is a friction pad.

3. The paper feeding device according to claim 1, wherein the feeding element is a roller.

4. The paper feeding device according to claim 1, wherein the first elastic element is a spring.

5. The paper feeding device according to claim 1, further comprising a one-way wheel coupled to the gear to limit the gear to rotate in the single direction.

6. The paper feeding device according to claim 1, wherein the guiding structure has a slide slot in which the paper-pushing structure is slidably disposed.

7. The paper feeding device according to claim 1, wherein the gear further comprises a second engaging part, when the gear rotates such that the second engaging part engages with the paper-pushing structure and drives the paper-pushing structure to move against the elastic force of the first elastic element, a portion of the paper-pushing structure protrudes beyond the supporting surface via the slot and moves toward the inclined supporting plane along the slot and is positioned at a particular location on the supporting surface.

8. The paper feeding device according to claim 1, wherein the paper-pushing structure comprises:

a main body slidably disposed on the guiding structure and comprising a rack for engaging with the first engaging part of the gear;

a paper-pushing element corresponding to the slot for pushing the paper sheets to move; and a second elastic element interconnected between the main body and the paper-pushing element, wherein when the paper sheets are pushed to the inclined supporting plane, a minimal distance between the paper-pushing element and the inclined supporting plane is adjusted to be substantial equal to an overall thickness of a stack of the paper sheets by using the elastic deformation of the second elastic element.

9. The paper feeding device according to claim 8, wherein the second elastic element is a spring.

* * * * *